United States Patent [19]

Libeer et al.

[11] 3,957,490

[45] May 18, 1976

[54] METHOD OF PREPARING PHOTOGRAPHIC SILVER HALIDE EMULSIONS

[75] Inventors: Marcel Jan Libeer, Mortsel; Frans Henri Claes, Boechout, both of Belgium

[73] Assignee: AGFA-GEVAERT N.V., Mortsel, Belgium

[22] Filed: Apr. 25, 1974

[21] Appl. No.: 464,230

[30] Foreign Application Priority Data

Apr. 26, 1973 United Kingdom ..... 19950/73

[52] U.S. Cl. ..... 96/94 R; 96/109; 96/110

[51] Int. Cl.[2] ..... G03C 1/02; G03C 1/24; G03C 1/30

[58] Field of Search ..... 96/94 R, 114.7, 114.8, 96/109, 110

[56] References Cited

UNITED STATES PATENTS

| | | | |
|---|---|---|---|
| 3,507,657 | 4/1970 | Kitze | 96/94 R |
| 3,531,291 | 9/1970 | Bacon | 96/108 |
| 3,672,901 | 6/1972 | Ohkubo et al. | 96/94 R |

OTHER PUBLICATIONS

F. Degering, Editor, An Outline of Organic Chemistry, Fourth Edition, Barnes & Noble; N. York, 1943.

*Primary Examiner*—David Klein
*Assistant Examiner*—Alfonso T. Suro Pico
*Attorney, Agent, or Firm*—William J. Daniel

[57] ABSTRACT

Silver halide emulsions are prepared by silver halide precipitation in the presence of a reducing agent, physical ripening and, if desired, chemical ripening wherein subsequent to the addition of reducing agent and before the grains have reached their final size an oxidizing agent is added to the emulsion. By means of the reducing and oxidizing agents, the gradation and photosensitivity characteristics of the emulsion can be controlled at will.

9 Claims, No Drawings

METHOD OF PREPARING PHOTOGRAPHIC SILVER HALIDE EMULSIONS

The present invention relates to a process for the preparation of photographic silver halide emulsions and to photographic elements containing such emulsions.

The preparation of a silver halide emulsion basically consists of a number of stages which are as follows:

1. the precipitation of very small silver halide grains, called emulsification by mixing an aqueous solution of a water-soluble silver salt commonly silver nitrate with an aqueous solution of a water-soluble halide commonly an ammonium halide or alkali metal halide in the presence of a hydrophilic colloid, in particular gelatin, which may be dissolved in either or both of the above solutions or in a separate aqueous solution;
2. the growth of the grains to the appropriate size, called physical ripening,
3. the removal of the by-products from the grain formation and growth stage, called washing,
4. if desired the sensitization of the silver halide grains to obtain the desired speed, called chemical ripening or chemical sensitization,
5. the final preparation including the addition of spectral sensitizers (if desired), and the addition of other conventional emulsion ingredients before coating.

It is known that at the conclusion of the emulsification stage and even after physical ripening the photographic emulsions have rather poor sensitivity.

The photosensitivity and generally also the gradation are markedly improved by the chemical sensitization according to which sensitivity specks are formed in the silver halide grains. During the exposure of the emulsion, developable latent image nuclei are formed at or in the neighbourhood of these sensitivity specks. When these specks are located in the interior of the silver halide grains, the latent image nuclei are formed upon exposure substantially in the interior of the grains. However, when these specks are at the surface of the silver halide grains, the latent image nuclei will also form upon exposure substantially at the surface of the grains. Therefore, the relative position of the sensitivity specks and thus also of the latent image nuclei will determine whether the developer should be a common surface developer or an internal developer comprising a silver halide solvent.

By appropriate chemical sensitization or ripening according to which sensitivity specks are formed e.g. silver sulphide nuclei and/or noble metal nuclei such as silver and gold nuclei, it is possible to obtain silver halide emulsions of high sensitivity.

In Belgian Patent 794,188 filed Jan. 18, 1973 by AgfaGevaert AG a method of preparing photographic silver halide emulsions has been described which comprises the steps of silver halide precipitation, physical ripening or grain-growth and, if desired, chemical ripening wherein during precipitation of the silver halide grains or before or during physical ripening reducing conditions are created in the emulsion in such a way that no latent image nuclei are formed which means that no spontaneously developable fog (a fog density of more than 0.20) can be detected by treating a sample of the emulsion coated on a GV.687C support at a coverage corresponding to 3 g of silver nitrate per sq.m., for 4 min. at 20°C with a surface developer solution of the following composition:

| | | |
|---|---|---|
| p-monomethylaminophenol sulphate | 1.5 | g |
| anhydrous sodium sulphite | 25 | g |
| hydroquinone | 6 | g |
| anhydrous sodium carbonate | 40 | g |
| potassium bromide | 1 | g |
| water to make | 1000 | ml |

The reducing conditions in the preparation stage of the silver halide grains before they reach their final size are created by addition of a silver halide reducing agent to the precipitation medium or by carrying out the precipitation under the conditions of the so-called "Silver digestion" technique described by H. W. Wood, J. Phot. Sci. 1 (1953) 163 according to which the pAg is held relatively low from 7 to 0, preferably 3 at relatively high temperature of about 50°C, the pH being preferably from 7 to 10.

It can be learned from the above Belgian Patent that by the creation of the reducing conditions at the stage of silver halide grain formation before the grains reach their final size, the rule of topographic association of the sensitivity specks with the latent image nuclei is no longer followed.

According to the method of the above Belgian Patent the reducing conditions create a change in the chemical structure of the grains probably in the form of centres of reductolytic silver. These centres do not act as the sensitivity specks formed at the chemical sensitization stage since during exposure latent image nuclei are formed at the surface of the grains and not in the interior of the grains where the centres are formed by the reducing conditions.

The silver halide emulsions prepared according to the method of the above Belgian Patent have improved photosensitivity and/or reduced gradation as compared with emulsions of corresponding mean grain diameter and grain-size distribution but prepared without creating the reducing conditions.

Though the reduced gradation may be desirable for some purposes e.g. continuous-tone reproduction it is often desired to obtain increased photosensitivity without reducing the gradation or with retention of as high a gradation as possible.

It is an object of the present invention to provide silver halide emulsions of increased photosensitivity by effecting precipitation of the silver halide grains in the presence of a reducing agent.

It is another object of the present invention to reduce or eliminate decrease of gradation caused by the said reducing agent both in the straight line portion and the toe of the density vs. log exposure curve.

A further object of the present invention is to control at will during silver halide grain formation the gradation and photosensitivity characteristics of the silver halide emulsion.

The above objects and other objects which will become apparent from the further disclosures have been accomplished by precipitation of the silver halide grains in the presence of a silver halide reducing agent i.e. by addition of a reducing agent to the precipitation medium before or during precipitation and subsequently adding an oxidizing agent before the silver halide grains have reached their final size, preferably still during precipitation or at the end of the precipitation stage i.e. prior to physical ripening.

The present invention thus provides a method of preparing photographic silver halide emulsions which comprises the steps of silver halide precipitation in the presence of a reducing agent, followed by physical ripening or grain growth and, if desired, chemical ripening, wherein subsequent to the addition of reducing agent and before the silver halide grains have reached their final size, an oxidizing agent is added to the emulsion. The reducing agent may be added to the precipitation medium before and/or during the precipitation of the silver halide.

The precipitation of the silver halide grains may occur according to the classical single-jet or double-jet processes or by a continuous precipitation process.

In the single-jet process an aqueous solution of a water-soluble silver salt, mostly silver nitrate, is run through a jet into a stirred aqueous solution containing a water-soluble halide or a mixture of water-soluble halides, a silver halide peptizer, preferably gelatin, and optionally other usual ingredients. In the double-jet process an aqueous solution of the silver salt and an aqueous solution of the halide are added simultaneously by two separate jets to a stirred solution of peptizer.

The reducing agent may be added to the precipitation medium before precipitation starts or during precipitation either by means of a separate jet of such agent or via the jet from which the halide solution is added in the double-jet process. Adding the reducing agent to the solution of silver salt is not suitable for carrying out the method of the present invention because the reducing agent may then be used up before the formation of the silver halide grains starts.

The oxidizing agent is added, after the addition of reducing agent and before the silver halide grains have reached their final size, preferably during or at the end of the precipitation stage. The oxidizing agent can be added by means of a separate jet or by means of the jet from which the halide solution is added in the double-jet process.

According to one embodiment of the method of the present invention, the reducing agent is present in the solution of peptizer before precipitation starts and the oxidizing agent is added at some time interval during precipitation or at the end of the precipitation. It is possible to interrupt precipitation i.e. to interrupt addition of silver salt solution in the above single jet process or to interrupt the addition of both the silver salt and halide solutions in the above double jet process at the moment the oxidizing agent is added.

According to another embodiment of the method of the present invention, reducing agent is added as a separate jet at one time interval of the precipitation and the oxidizing agent is added at a later time interval of the precipitation. Precipitation can be interrupted during the addition of reducing and/or oxidizing agent.

The invention is not to be regarded as limited to one of the above embodiments. It includes whatever embodiment according to which precipitation of the silver halide grains occurs at one or other time interval in the presence of a reducing agent and an oxidizing agent is added at a later time interval before the grains have reached their final size.

In carrying out the invention neither the addition of reducing agent nor the addition of oxidizing agent need necessarily occur in one step or in a short time; on the contrary, such addition may take place intermittently and be spread over a substantial period of time.

The reducing and oxidizing agents can be added from solutions in water or water-miscible solvents or mixtures of both. Suitable water-miscible solvents are lower alcohols e.g. methanol and ethanol and ketones e.g. acetone and methyl ethyl ketone.

Any reducing agent for silver halide, both inorganic and organic compounds, is suitable for the purpose of the invention provided it does not contain a labile sulphur atom.

Suitable reducing agents are e.g. hydrazine, hydrazine derivatives, ascorbic acid, hydroquinone, thiourea dioxide, tin(II)chloride, etc. Thiourea dioxide is preferred because of the reproducible results that can be obtained therewith.

The oxidizing agent used in accordance with the present invention also includes both inorganic and organic compounds. Suitable examples are iodine, potassium hexacyanoferrate(III), bromosuccinimide, p-quinone, potassium periodate potassium persulphate, sodium nitroprussiate, N(m-nitrobenzyl)quinolinium chloride, etc.

In view of the subsequent treatment with the oxidizing agent, the amount of reducing agent is not necessarily limited, as is set forth in the above Belgian Patent, so that no spontaneously developable fog is produced. However, the ultimate result of the addition of reducing agent and oxidizing agent should be such that a sample taken from the emulsion thus treated, when coated on a support at a coverage corresponding to 3 g of silver nitrate per sq.m., gives a density of at most 0.20 upon processing, without exposure, for 4 min. at 20°C in a surface developer of the composition hereinbefore specified.

Usually the reducing agent is added in the amount necessary to obtain the optimum sensitivity whereupon the oxidizing agent is added in the amount to increase the gradation to the desired extent with increase or maintenance of the photosensitivity reached by the addition of the reducing agent.

For the purpose of the invention it usually suffices to use an amount of reducing agent not exceeding $0.75 \times 10^{-2}$ milliequivalent per g ion of silver.

In accordance with the present invention it is preferred to use from about 0.5 mg to about 10 mg of thiourea dioxide per kg of silver nitrate used at the precipitation stage.

The amount of oxidizing agent depends on the particular oxidizing agent used i.e. its oxido-reduction potential, as well as on the type and amount of reducing agent used. Gradation increases with increasing amounts of oxidizing agent until an optimum is reached beyond which the gradation decreases again.

In accordance with the present invention, it is possible, by controlling the addition of reducing agent and oxidizing agent, to obtain optimum photosensitivity and gradation characteristics. This control can be easily effected during precipitation by some simple tests on samples taken from the emulsion.

It is even possible to obtain desired sensitivity and gradation characteristics by alternate addition of reducing agent and oxidizing agent.

The method of the present invention can be used for the preparation of any kind of silver halide emulsion which includes emulsions of which the silver halide is silver chloride, silver bromide, silver chloroiodide, silver bromoiodide and silver chlorobromoiodide. The emulsions include emulsions prepared by conversion of a silver chloride emulsion into silver chlorobromide and silver bromide emulsions, optionally comprising small amounts of silver iodide, by digestion with bromide before chemical ripening(if any); for example the silver chloride emulsion can be prepared in the presence of reducing agent and conversion to obtain the final grain can take place in the presence of oxidizing agent.

It can be used for the preparation of coarse-grain as well as fine-grain emulsions, and for the preparation of monodisperse as well as heterodisperse emulsions which as is known to those skilled in the art depends on the precipitating conditions especially the pH and the pAg. Monodisperse emulsions in contrast to heterodisperse emulsions are emulsions with narrow grain-size distribution which means that at least 95 % of the silver halide grains have a diameter which is within 40 %, preferably within 30 % of the mean grain diameter. Methods for preparing monodisperse emulsions have been described by Klein and Moisar in the Journal of Photographic Science, Vol. 12, 1964 — pages 242–251 "Properties of Photographic Emulsion Grains".

After the precipitation of the silver halide grains in the presence of a reducing agent and the subsequent addition of an oxidizing agent as described above, before the grains have reached their final size, the emulsion preparation is continued as is common in the art.

The further steps in the preparation of the silver halide emulsion following the precipitation and the growth of the silver halide grains to the appropriate size called physical ripening, are normally: the removal of the by-products from the grain-formation and growth stage, called washing e.g. noodle washing, coagulation washing and washing by means of a hydrocyclone, the chemical sensitization or ripening of the silver halide grains, and the final preparation including addition of spectral sensitizers (if desired) and the addition of other conventional emulsion ingredients before coating.

The silver halide emulsions prepared in accordance with the present invention may be chemically sensitized by effecting the ripening in the presence of small amounts of sulphur-containing compounds such as allyl thiocyanate, allyl thiourea, sodium thiosulphate, etc. The emulsions may also be chemically sensitized by means of reductors for instance tin compounds as described in British Patent 789,823 filed Apr. 29, 1955 by Gevaert Photo-Producten N.V., and small amounts of noble metal compounds such as gold, platinum, palladium, iridium, ruthenium and rhodium compounds as described by R. Koslowsky, Z.Wiss.Photo, 46, 65–72 (1951).

The emulsions may be spectrally sensitized or not. It is advantageous to sensitize them spectrally according to methods well known in the art to make them ortho-sensitized or panchromatically sensitized. Spectral sensitizers that can be used are e.g. the cyanines, merocyanines, complex (trinuclear) cyanines, complex (trinuclear) merocyanines, styryl dyes, oxonol dyes and the like. Suchlike spectrally sensitizing dyes have been described by F. M. Hamer in "The Cyanine dyes and related Compounds" (1954).

The emulsions may be hardened in the conventional way e.g. by means of formaldehyde, halogen-substituted aldehydes e.g. mucochloric acid and mucobromic acid, glutaraldehyde, diketones, dioxan derivatives, aziridine, oxypolysaccharides, methansulphonic acid esters, etc.

Other conventional addenda may be added to the emulsions e.g. plasticizers, coating aids, antistaining agents, developing agents, colour couplers, compounds that sensitize the emulsions by development acceleration, fog-inhibitors and emulsion-stabilizing agents, etc.

Compounds that sensitize the emulsions by development acceleration are e.g. alkylene oxide polymers. These alkylene oxide polymers may be of various type e.g. polyethylene glycol having a molecular weight of 1500 or more, alkylene oxide condensation products or polymers as described among others in United States Patents 1,970,578 of Conrad Schoeller and Max Wittwer issued Aug. 21, 1934, 2,240,472 of Donald R. Swan issued Apr. 29, 1941, 2,423,549 of Ralph Kingsley Blake, William Alexander Stanton and Ferdinand Schulze issued July 8, 1947, 2,441,389 of Ralph Kingsley Blake issued May 11, 1948, 2,531,832 of William Alexander Stanton issued Nov. 28, 1950, and 2,533,990 of Ralph Kingsley Blake issued Dec. 12, 1950, in United Kingdom Patent Specifications 920,637 filed May 7, 1959, 940,051 filed Nov. 1, 1961 and 945,340 filed Oct. 23, 1961 all by Gevaert Photo-Producten N.V. and 991,608 filed June 14, 1961 by Kodak Ltd. and in Belgian Patent 648,710 filed June 2, 1964 by Gevaert Photo-Producten N.V. Other compounds that sensitize the emulsion by development acceleration and that may be used in combination with the foregoing polymeric compounds are quaternary ammonium and phosphonium compounds and ternary sulphonium compounds as well as onium derivatives of amino-N-oxides as described in United Kingdom Patent 1,121,696 filed Oct. 7, 1965 by Gevaert Photo-Producten N.V.

The emulsions may comprise the common antifoggants and emulsion stabilizers e.g. homopolar or salt-like compounds of mercury with aromatic and heterocyclic rings (e.g. mercaptotriazoles) simple mercury compounds, mercury sulphonium double salts and other mercury compounds of the kind described in Belgian Patents 524,121 filed Nov. 7, 1953 by Kodak Ltd., 677,337 filed March 4, 1966, 707,386 filed Dec. 1, 1967 and 709,195 filed Jan. 11, 1968 all by Gevaert-Agfa N.V. Other suitable emulsion stabilizers are the azaindenes, particularly the tetra- or pentaazaindenes and especially those substituted by hydroxy- or amino groups. Suchlike compounds have been described by Birr in Z.Wiss.Photo 47, 2–58 (1952). The emulsions may further comprise as stabilizers heterocyclic nitrogen-containing mercapto compounds such as benzothiazoline-2-thione and 1-phenyl-5-mercapto-tetrazole, sulphinic acids such as benzene sulphinic acid and toluene sulphinic acid, thiosulphonic acids such as benzene thiosulphonic acid, toluene thiosulphonic acid, p-chlorobenzene thiosulphonic acid sodium salt, propyl thiosulphonic acid potassium salt, butyl thiosulphonic acid potassium salt, etc.

Though gelatin is preferably used as hydrophilic colloid binder for the silver halide it is also possible to use other hydrophilic colloids e.g. casein, zein, polyvinyl alcohol, carboxymethyl cellulose, alginic acid, etc.

The emulsions prepared in accordance with the present invention can be used for the formation of a wide variety of photographic materials e.g. phototechnical films, copying or direct-recording materials, X-ray films, photographic elements intended for colour photography, photographic materials of use in the silver complex diffusion transfer process, etc.

The following examples illustrate the present invention.

EXAMPLE 1

Comparison Emulsion A

A silver bromoiodide emulsion (1 mole % of iodide) was prepared by double-jet precipitation at 60°C according to which a 1.5 molar aqueous solution of silver nitrate and a 1.5 molar aqueous solution of both potassium bromide and potassium iodide were added to 1 liter of a 2 % aqueous solution of gelatin.

The excess of halide was controlled so that a pAg value was obtained corresponding to an E.M.F. of 0 millivolt. (Ag/saturated reference calomel electrode). The pH was maintained at a value of 5.8.

The silver nitrate was added at a ratio of 57 ml per min. the complete precipitation time lasting 13 min.

The mean grain-size of the crystals obtained was 0.2 $\mu$m.

The silver halide emulsion was coagulation washed using ammonium sulphate whereupon the coagulum was redispersed.

The emulsion was chemically ripened by means of $Na_3[Au(S_2O_3)_2]$ (9 mg per mole of silver bromide) and coated on a subbed polyethylene terephthalate support at a coverage of silver halide corresponding to about 3 g of silver nitrate per sq.m.

Comparison Emulsion B

This emulsion was prepared in exactly the same way as emulsion A with the only difference that the 2 % aqueous solution of gelatin into which the silver bromide was precipitated comprised 1 mg of thiourea dioxide per kg of silver nitrate used in the precipitation.

Emulsions C, D and E

These emulsions were prepared in the same way as emulsion B with the only difference that after 4 min. of precipitation the precipitation was interrupted and iodine was added in the amount listed in the table below from a 2 % solution in ethanol Precipitation was then continued for 9 min.

The coated emulsions were exposed for 0.05 sec through a neutral density step wedge with constant 0.20 by means of a tungsten lamp of 750 W placed at a distance of 40 cm. The exposed emulsions were developed for 4 min. at 20°C by means of a developer of the following composition:

| | | |
|---|---|---|
| water | 800 | ml |
| p-monomethylaminophenol sulphate | 1.5 | g |
| anhydrous sodium sulphite | 25 | g |
| hydroquinone | 6 | g |
| anhydrous sodium carbonate | 40 | g |
| potassium bromide | 1 | g |
| water to make | 1000 | ml |

The sensitometric results attained are listed in the following table. The gamma ($\gamma$) is the gradient of the straight-line portion of the density vs.log exposure curve. The values given for the speed measured at density 1, above fog are relative values; a value of 100 was given for the speed of emulsion A.

Table

| emulsion | iodine per kg of silver nitrate | Fog | Speed | $\gamma$ |
|---|---|---|---|---|
| A | — | 0.03 | 100 | 0.99 |

Table-continued

| emulsion | iodine per kg of silver nitrate | Fog | Speed | $\gamma$ |
|---|---|---|---|---|
| B | — | 0.04 | 174 | 0.63 |
| C | 40 mg | 0.04 | 174 | 1.05 |
| D | 200 mg | 0.03 | 105 | 0.53 |
| E | 1000 mg | 0.03 | 87 | 0.30 |

The above results show the speed-increase and reduction in gamma obtained when precipitation is carried out in the presence of a reducing agent (emulsion B). They also show that by addition of an oxidizing agent the reduction in gamma can be eliminated with retention of high speed (emulsion C).

It is further shown that the effect of the addition of the oxidizing agent is dependent on the amount of oxidizing agent and that after having reached an optimum both speed and gradation decrease again.

EXAMPLE 2

Emulsions were prepared as described in example 1 with the only difference that varying amounts of thiourea dioxide were added to the precipitation medium before the precipitation and that the iodine was added in the amounts and at the moment of precipitation listed in the table below.

The sensitometric results attained are listed in the following table.

The gamma ($\gamma$) is the gradient of the straight line portion of the density vs.log exposure curve. The gamma in the toe of the density vs.log exposure curve ($\gamma_t$) is the gradient of the curve at a density 0.1 above fog. The values given for the speed measured at density 0.1 above fog are relative values; a value of 100 was given for the speed of the emulsion prepared by addition of 1 mg of thiourea dioxide to the precipitation medium and no addition of oxidizing agent.

Table

| per kg of thiourea dioxide | silver nitrate iodine | time of addition of iodine (min.) | fog | $\gamma$ | $\gamma_t$ | speed |
|---|---|---|---|---|---|---|
| 1 mg | O | 0 | 0.04 | 1.09 | 1.09 | 100 |
| 1 mg | 50 mg | 4 | 0.04 | 1.17 | 1.17 | 102 |
| 1 mg | 50 mg | 8 | 0.04 | 1.24 | 1.24 | 86 |
| 2 mg | O | 0 | 0.05 | 1.07 | 0.96 | 105 |
| 2 mg | 50 mg | 4 | 0.05 | 1.25 | 1.25 | 93 |
| 2 mg | 100 mg | 4 | 0.04 | 1.22 | 1.22 | 93 |

The above results show that with retention of approximately the same speed, the addition of iodine increases gamma both in the toe and the straight line portion of the density vs.log exposure curve.

EXAMPLE 3

Emulsions were prepared in the prescence of reducing agent alone or in the presence of reducing agent and by subsequent addition of oxidizing agent as described in example 1 with the only differences that now silver bromide emulsions containing no silver iodide were prepared and that instead of iodine, the oxidizing agents listed in the table below were added in the amounts given. The values given for the speed measured at density 0.1 (speed I) and 1 (speed II) above fog are relative values as in the foregoing tables.

| oxidizing agent per kg $AgNO_3$ | fog | speed I | speed II | γ |
|---|---|---|---|---|
| — | 0.04 | 100 | 100 | 2.26 |
| 50 mg of bromosuccinimide | 0.05 | 135 | 115 | 2.52 |
| 100 mg of bromosuccinimide | 0.05 | 132 | 105 | 2.53 |
| 600 mg of potassium hexacyanoferrate(III) | 0.05 | 89 | 93 | 2.64 |
| 900 mg of potassium hexacyanoferrate(III) | 0.04 | 117 | 129 | 3.21 |
| 1 mg of sodium nitroprussiate | 0.05 | 144 | 148 | 2.56 |

The above results show the favourable effect on gamma and speed of the addition of oxidizing agent.

We claim:

1. In the method of preparing photographic silver halide emulsions by the steps comprising precipitating silver halide in the presence of a reducing agent for silver halide and subjecting the precipitated silver halide to physical ripening and grain-growth, the improvement of adding an oxidizing agent to said emulsion after precipitation of said halide in the presence of said reducing agent has been initiated but before the precipitated grains have reached their ultimate size.

2. Method according to claim 1, wherein the amounts of both reducing and oxidizing agent are such that the emulsion when coated on a support at a coverage corresponding to 3 g of silver nitrate per sq.m., gives a density of at most 0.20 upon processing, without exposure, for 4 min. at 20°C in a surface developer of the following composition:

| | | |
|---|---|---|
| p-monomethylaminophenol sulphate | 1.5 | g |
| sodium sulphite (anhydrous) | 25 | g |
| hydroquinone | 6 | g |
| sodium carbonate (anhydrous) | 40 | g |
| potassium bromide | 1 | g |
| water to make | 1000 | ml. |

3. Method according to claim 1 wherein oxidizing agent is added during or at the end of said precipitation step.

4. Method according to claim 1 wherein reducing agent is added to the precipitation medium before precipitation starts and oxidizing agent is added during the precipitation of the silver halide.

5. Method according to claim 1, wherein both reducing agent and oxidizing agent are added during the precipitation of the silver halide, with the reducing agent being added in advance of the oxidizing agent.

6. Method according to claim 1, wherein the reducing agent is thiourea dioxide.

7. Method according to claim 1, wherein the oxidizing agent is iodine, potassium hexacyanoferrate(III), bromosuccinimide, or sodium nitroprussiate.

8. Method according to claim 1, wherein the reducing agent is added in an amount not exceeding $0.75 \times 10^{-2}$ milliequivalent per g ion of silver.

9. Method according to claim 6 wherein the thiourea dioxide is used in an amount from about 0.5 mg to about 10 mg per kg of silver nitrate used at the precipitation step.

* * * * *